United States Patent [19]

Hillstrom

[11] Patent Number: 5,040,586

[45] Date of Patent: Aug. 20, 1991

[54] BANNER HOLDING DEVICE

[75] Inventor: David U. Hillstrom, Novi, Mich.

[73] Assignee: Marketing Displays, Inc., Farmington Hills, Mich.

[21] Appl. No.: 549,925

[22] Filed: Jul. 2, 1990

[51] Int. Cl.[5] ..... G09F 17/00

[52] U.S. Cl. ..... 160/383; 160/327; 160/368.1; 40/603

[58] Field of Search ..... 248/297.2, 298, 309.1, 248/309.2, 317, 323, 339, 475.1; 160/383, 398, 402, 404, 330, 327, 368.1; 40/904, 584, 603, 604, 611, 617

[56] References Cited

U.S. PATENT DOCUMENTS

| | | | |
|---|---|---|---|
| 3,379,237 | 4/1968 | Worthington | 160/383 |
| 4,580,361 | 4/1986 | Hillstrom | 40/603 |
| 4,805,330 | 2/1989 | Bubernak | 160/383 |

FOREIGN PATENT DOCUMENTS

| | | | |
|---|---|---|---|
| 2039982 | 8/1980 | United Kingdom | 160/383 |

*Primary Examiner*—Ramon O. Ramirez
*Assistant Examiner*—Robert A. Olson
*Attorney, Agent, or Firm*—Brooks & Kushman

[57] ABSTRACT

A frame device (12) for securely holding and hanging banners (14) and the like from buildings and surfaces. The frame has a base portion (16) which is attached to the building or surface and a spring loaded rotating cover portion (18) which covers a channel (52) in the base. A plurality of inner slidingly adjustable hook members (60) and a pair of outer clip lock members (80) positioned in the channel hold the banner in place. The banner has a plurality of mating holes or apertures (74) along one edge and hangs from the hook and lock members in the frame device. Once the banner is positioned on the hooks, the cover portion is closed securely retaining the banner in place.

9 Claims, 2 Drawing Sheets

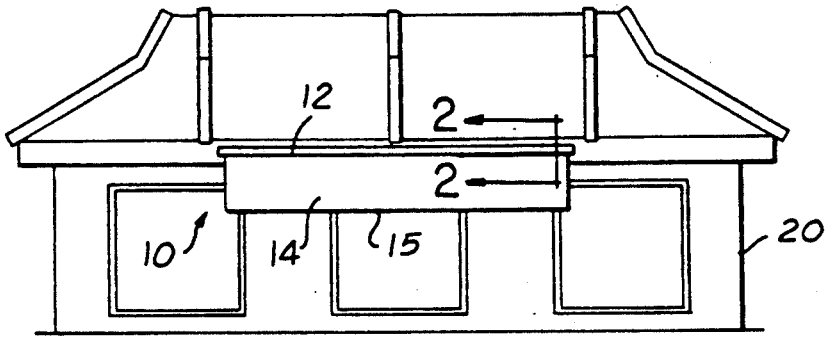
FIG. 1
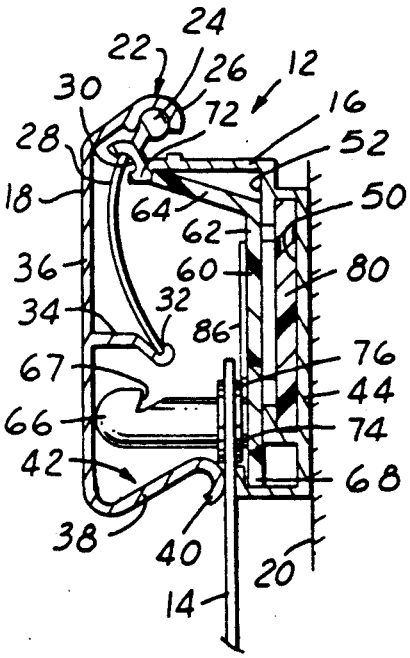
FIG. 2
FIG. 3
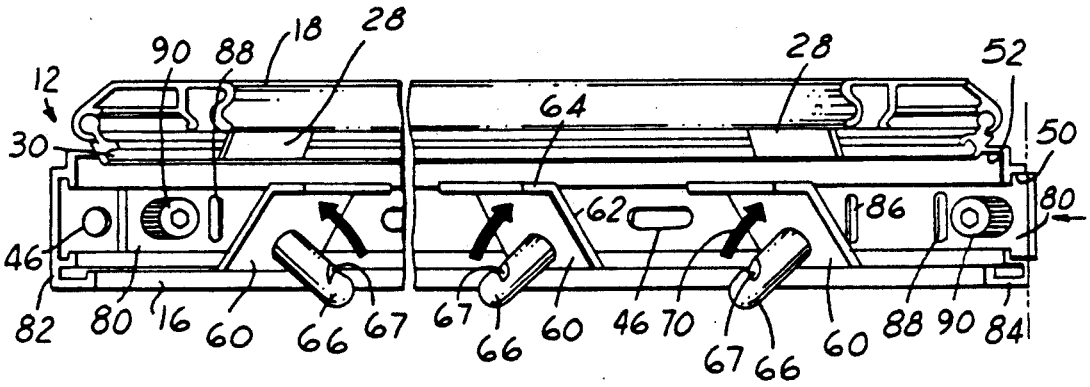

BANNER HOLDING DEVICE

TECHNICAL FIELD

The present invention relates to an improved system for holding and displaying banners and the like on buildings and surfaces. An unique frame apparatus positioned on the building or surface has a plurality of adjustable slide hook members which mate with apertures in the banner. The banner hangs from the hooks and a rotating cover on the frame apparatus holds it securely in place. Clip lock members securely hold the slide hook members in place at the outer ends of the frame apparatus. The slide hook members and the clip lock members are easily adjustable to allow for variable spacing of banner apertures and to prevent sagging.

BACKGROUND ART

The secure and aesthetic placement of banner-type advertising and message signs on buildings and wall surfaces is a desired objective today. Where the signs are to be positioned outdoors and subjected to harsh environmental conditions, known devices and systems have frequently proven unreliable.

There are numerous known systems and devices for holding and displaying signs and messages. Where elongated signs and messages are employed (a/k/a "banners"), the known systems and devices have not always proven to be reliable. They often are unattractive, bulky, expensive, difficult to install and difficult to change messages. This is particularly true where the banners are adapted to be placed outdoors where they are subjected to high winds and other harsh conditions.

When used as a banner-type system for consumer oriented businesses, such as fast food restaurants, it is desirable to install the banner in a "high-traffic" or "high-visibility" position, install it in a manner which is attractive and visible and yet not be in the way of the consumers, allow relative quick and easy installation and change of the banners, keep the banner taut without sagging, and be inexpensive. The systems also must firmly and securely hold the banner in place so it cannot be removed without express manual effort (that is, so it will not be blown out, torn or dislodged accidently or inadvertently by high winds or other adverse weather conditions). The system further should be able to be installed quickly and easily by untrained personnel, as well as allow changing of the message banner by the same personnel in a quick and easy manner.

It is an object of the present invention to provide an improved system and device for holding and displaying banner-type signs and messages. It is also an object to provide a banner-type display apparatus and system which is aesthetic, inexpensive, and allows relatively quick and easy changes of the banners.

It is a further object of the present invention to provide a banner-type display apparatus which is easy to install and is lightweight and unobtrusive. It is still another object of the invention to provide a banner-type display device which firmly and securely retains and displays banner-type signs and messages regardless of the severity of the external weather conditions.

It is still further objects of the present invention to prevent sagging of banner-type signs and messages and to allow for various sizes and grommet spacing using adjustable hook or retention members to meet the variations.

The above and other objects of the invention are met by the inventive display system and apparatus disclosed and claimed in this application.

DISCLOSURE OF THE INVENTION

In the inventive system, an elongated frame-type track or device is supplied which has a base portion and a cover portion. The base portion is adapted to be installed on a building or wall surface. The cover portion is rotatably hinged to the base portion and biased by a spring member to its closed position.

The base portion has an elongated channel in which a plurality of slidable hook members are positioned. A clip lock member with a hook attached is positioned at each end of the channel and adapted to be tightly secured in place by a manually tightened screw member.

The banner has a plurality of holes or apertures along one edge. The hooks are slid along the channel for proper positioning and the apertures in the banner are placed over the hooks. After the banner is installed in position on all of the hooks, the cover portion of the frame device is rotated to its closed position covering the hooks. The cover prevents the banner from being accidently or inadvertently displaced from the hooks. The adjustability of the hooks and clip lock members allow for variations in the sizes and spacings of apertures in the banner and prevent the banner from sagging.

In order to remove or replace the banner, the cover is opened and the process repeated. The frame device is aesthetic and unobtrusive and does not detract from the lines or appearance of a building whether or not a banner is installed in it.

BRIEF DESCRIPTION OF THE DRAWINGS

FIG. 1 illustrates the use of the present invention on a building;

FIG. 2 is a cross-sectional view of the invention taken along line 2—2 in FIG. 1;

FIG. 3 is a schematic perspective view of the invention with the cover member in its open position and illustrating the installation of the slide hook members;

BEST MODE FOR CARRYING OUT THE INVENTION

Figure 4:
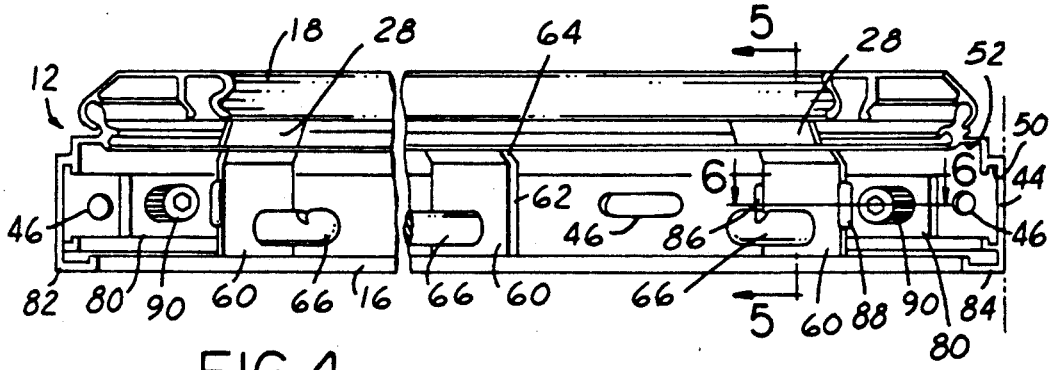
FIG. 4 is a schematic perspective view of the invention with the cover member in its open position.

The use of the frame device and system 10 is illustrated in FIG. 1. The frame is depicted installed in place on a building 20 which, as shown, is a popular type of fast food restaurant. It is understood, of course, that the present invention is not limited for use on buildings, but can be used on any wall, surface, or fascia, or on posts, a fence or the like. It is also understood that the use of the present invention is not limited to outdoor use (even though this is the preferred use at this time). The invention can be used anywhere—either outdoors or indoors—where it is desired to hang or display a sign or banner.

The system 10 has a frame device 12 which holds a banner 14 or the like. For ease of reference, the display being used with the frame device 12 will be referred to as a "banner" since this is the preferred type of display contemplated for use with the frame device at this time. In this regard, "banner" generally means an elongated rectangular display which presents an advertisement or message for view by the passing public. It is understood, of course, that any type of sign or display of any size or shape can be utilized, so long as it meets the other requirements for the invention. Also, the banner or sign can have any type or style of message printed, painted or affixed thereon, such as an advertisement, informational message, etc.

The base and cover members of the frame device 12 are preferably made from extruded aluminum material since aluminum is strong, lightweight, relatively inexpensive, aesthetic and easily handled. Aluminum extrusions also can be finished or painted attractively in virtually any color or design, and aluminum does not corrode or rust like many other metals. It is understood, of course, that the members of the frame device 12 can be made from any type of metal or other materials which satisfy the requirements of the present invention.

The banner 14 also is preferably made from a vinyl or plastic material since such materials are strong, lightweight, present an aesthetic appearance and can be easily transported and handled. Plastic materials also are able to withstand harsh weather conditions with minimum damage. Of course, the banner can be made from any appropriate material, depending on whether it is to be displayed indoors or outdoors, and depending on the anticipated period of time for its display. Although banner materials are usually flexible, rigid sign materials may also be used with the present invention.

The frame device has two principal components, a base member 16 and a cover member 18. The members 16 and 18 are elongated materials and extruded in the cross-sectional shapes shown in the drawings. The base and cover members are rotatably attached together by hinge mechanism 22. The base member 16 has an elongated rounded pintal member 24 which sets in and mates with an elongated socket member 26 in the cover member 16.

A leaf spring 28 is positioned between an elongated arcuate-shaped channel 30 in the base member 16 and an elongated channel 32 in a flange 34 on the cover member 18. The spring 28 is preferably flat or substantially flat before it is positioned in place and it is bent to the configuration shown (see FIGS. 2 and 5) when it is installed in place between channels 30 and 32. The spring 28 also is preferably made from spring steel, although any equivalent material would be appropriate, and a number of springs 28 are provided along the length of the frame device 12.

Figure 5:
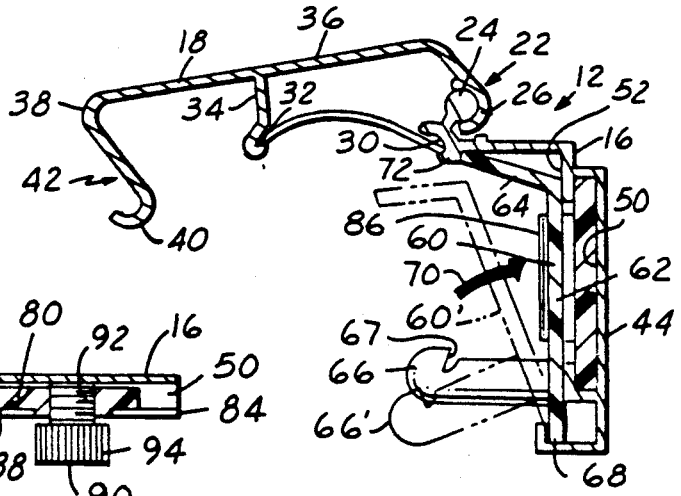
FIG. 5 is a cross-sectional view of the invention taken along line 5—5 in FIG. 4.

The spring 28 biases the cover and base members together. Due to the positioning and arrangement of the channels 30 and 32 in relation to the hinge mechanism 22, the spring provides an over-center force which firmly holds the cover member in either the closed position (as shown in FIG. 2) or the open position (as shown in FIG. 5). When the frame device 12 is in its open position (FIG. 5), it is held open by the over-center biasing force and this is when the banner 14 can be installed or changed (as described in more detail below). When the frame device 12 is in its closed position (FIG. 2), the cover is held firmly in the position shown and retains the banner 14 securely in the device 12.

The cover member 18 has a top portion 36 and a front wall portion 38. The top portion 36 is the principal visible surface. The wall portion 38 extends from the top portion towards the base portion 16 and has an edge 40 which is configured in the "closed" position to help hold the banner in place. The wall portion 38 also has a reverse curve or finger indentation 42 in it so the cover can be grasped manually for purposes of opening and closing the frame device.

When the frame device 12 is "closed", the inside surface of the top portion 36 of the cover member 18 is designed to either abut or be positioned immediately adjacent to the end of the hook member 66 (as shown in FIG. 2) whose purpose is described in more detail below. This design feature acts to help retain the banner 14 in the frame device 12.

Figure 7:
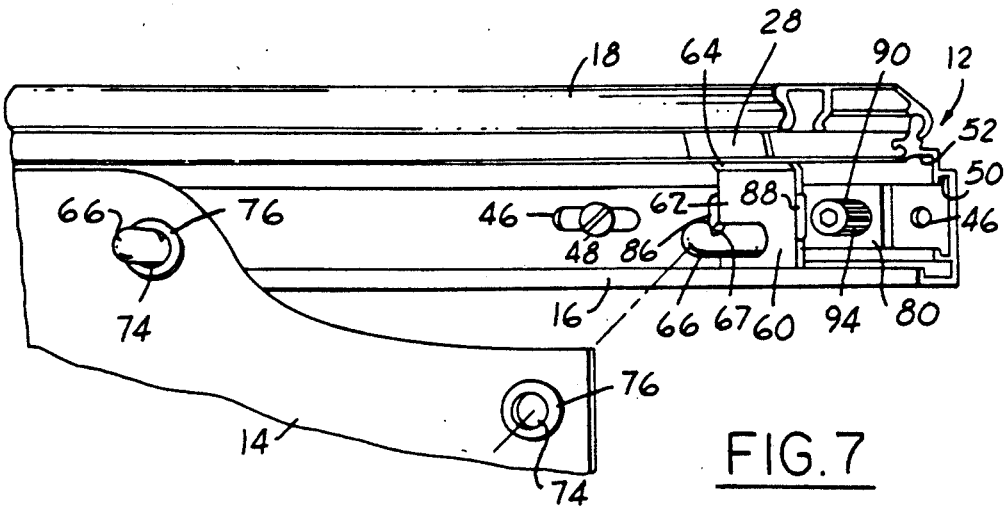
FIG. 7 is a schematic, perspective view of the invention illustrating the installation of a banner in the frame device.

The base member 16 has a back portion 44 which is preferably flat for mating with a wall or building surface. A series of holes or slots 46 can be provided in the back portion 44 to aid in installing the base member and thus the frame device 12 on the building 20 (or wall, fence, etc.). Screws, nails or other common fastening devices 48 (see FIG. 7) can be positioned in such holes or slots and used to securely fasten or anchor the frame device to the surface. The holes or slots 46 are provided in the rear surface of a first channel 50 in the base member. The depth and configuration of the first channel 50 allows screws or fastening devices 48 to be utilized to secure the frame device 12 to a building and at the same time not interfere with the movement of the slide hook members 60 (as described below).

A plurality of slide hook members 60 are situated in the base portions 16 of the frame devices 12. For this purpose, a second elongated channel 52 is provided in the base portion 16. The slide hook members 60 each have a back portion 62, an angled snap-in end portion 64, and a hook member 66.

The slide hook members 60 are installed in the base portions in the manner shown in FIGS. 3–5. As shown in phantom lines in FIG. 5, the lower edge 68 of the back portion 62 of the slide hook member is first positioned in the channel 52, and then the slide hook member 60 is forced in the direction of the arrow 70 toward the back portion 44 of the base portion 16 until the angled end portion 64 clears the edge 72 of the channel 52 and the slide hook member snaps into place in its final position.

Preferably, the slide hook members 60 and clip lock members 80 are made of a plastic material in the configurations shown, although other materials and configurations can be utilized. Plastic materials are lightweight, non-corrosive, and durable.

The slide hook members 60 can be moved or "slid" along the channel 52 in order to be positioned manually for proper installation of the banner 14. This feature accommodates for different sized banners, as well as banners with variations in spacing of the apertures. The hook members 66 protrude outwardly from the base member and are adapted to fit within mating holes or apertures 74 in the banner 14 (see FIGS. 2 and 7).

A series of holes or apertures 74 are provided along one edge of the banner 14 for this purpose. The holes 74 are preferably uniformly spaced along one edge for ease of hanging and for an unwrinkled, pleasing appearance to the displayed banner. Preferably, the holes or apertures 74 have rings or grommets 76 to reinforce the holes and prevent the banner from tearing.

The hook members 66 have a groove or slot 67 on them which provides a hook-like shape or structure. This helps prevent accidental or inadvertent removal of the banner 14 once it is positioned on the hooks and before the cover portion 18 is rotated to its closed position.

In order to insure that the banner 14 hangs properly from the frame device 12, it is also possible to provide an elongated reinforcing member along the unsecured bottom edge 15 of the banner 14, or to provide weights or a weighted member of some type along that edge.

Although only one frame device 12 is shown being positioned along one edge of the banner 14, it is also possible for other similar frame devices to be provided for other edges of the banner. For example, two frame devices could be positioned along the two opposite elongated edges of the banner in order to stretch and hold it in place firmly along both edges. For this purpose, holes or apertures 74 would be provided along both elongated edges of the banner.

Figure 6:
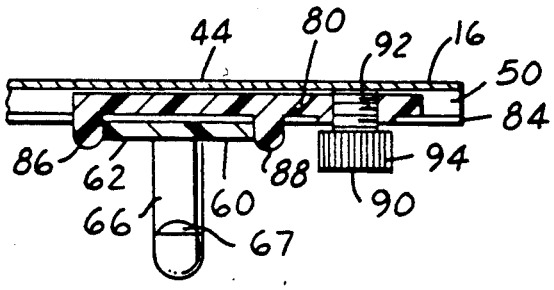
FIG. 6 is a cross-sectional view of the invention taken along line 6—6 in FIG. 4.

A clip lock member 80 is provided at each end 82, 84 of the frame device 12. The clip lock members 80 secure the end slide hook members 60 in place and prevent them from accidently or inadvertently being slid out of or removed from the base member 16. The adjustability of the clip lock members also helps accommodate for banners of different lengths or which have non-uniform spacing of the apertures. The clip lock members and their use and function are best shown in FIGS. 4 and 6.

The clip lock members 80 have a pair of ridges 86 and 88 and a locking screw 90. The ridges 86 and 88 confine and position a slide hook member 60 in a nesting relationship. The screw 90 is received in a threaded opening 92 in the member 80 and, when tightened against the back portion 44 of the base member 16, securely holds the clip lock member (and nested slide hook) in position. Preferably, the locking screws 90 are made of a plastic material and are capable of being tightened and loosened by hand. For this purpose, the heads of the screws 90 have a ridged or knurled surface 94. It is also possible to provide a slotted head screw (not shown) or a socket head screw (as shown) to allow turning of the screw by a hand tool.

After the frame device is attached to the building or surface and all the clip lock members and slide hook members are installed in place, a banner can be installed in it. For installation of a banner 14, the device 12 is first "opened" by rotating the cover member 18 to its open position (FIGS. 3–5). Then, preferably working in a left to right manner, the banner 14 is hung on the hook members 66. The outer-most hole on the left end of the banner is installed on a slide hook which is nested in a tightly secured clip lock member. Then, keeping a slight tension on the banner, the slide hooks 60 are manually slid into position and the hook members 66 inserted through corresponding holes 74. Once the final (right) end of the banner is reached, the clip lock is loosened, if needed, slid to the appropriate position, and finger tightened to secure it in place. The final hole in the banner is then positioned over the last hook member and the cover member 18 rotated to its closed position (see FIGS. 7 and 2, respectively).

When the banner is removed, the process is repeated in the reverse sequence. Removal of one banner and replacement with another banner are carried out in a similar manner.

The frame device 12 can be provided as one entire elongated device, or it can be provided in two or more sections which are abutted end-to-end when they are installed on the building 20 or other surface. When two sections are abutted and installed, it is preferable to use a splice or connector plate (not shown) that extends between two adjacent sections. The splice plate would be positioned in channels 50 of the adjacent sections.

Also, if the frame device is supplied in more than one section, each of the sections preferably is closed separately in sequence when the banner is being installed.

Although particular embodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

What is claimed is:

1. A display device for holding and displaying an elongated banner, said banner having a plurality of openings therein, said display device comprising:

a base member;

said base member having elongated channel means therein and two opposed ends;

a cover member rotatably attached to said base member;

bias means biasing said base member and said cover member together;

said cover member being rotatable between an open position for installation and removal of said banner and a closed position for retention and display of said banner;

at least one locking member positioned in said elongated channel means;

a plurality of first hook members freely slidably positioned in said elongated channel means, such first hook members being movable along the longitudinal axis of said base member;

at least one second hook member being releasably affixed in place by said locking member adjacent one of said opposed ends of said base member; and each of said first and second hook members having hook means thereon for mating with one of said openings in said banner.

2. A device for holding and displaying a sign member, the sign member having a plurality of apertures along one edge, the device comprising:

an elongated track member, said track member having a first elongated channel means, a second elongated channel means, and two opposed ends;

a plurality of first hook members positioned in said second channel means and each freely slidable therein lengthwise along the longitudinal axis of said track member;

a pair of second hook members positioned in said second channel means;

a pair of locking members positioned in said first channel means, one of said pair situated adjacent each of the opposed ends of the track member, each of said locking members releasably holding one of said pair of second hook members securely in position at one of said opposed ends; and each of said first and second hook members having protrusion means thereon for mating with one of said apertures in said sign member.

3. The device as set forth in claim 2 further comprising a cover member rotatably attached to said base member, said cover member covering said first and second hook members and said locking members when positioned in a closed position, and exposing said first and second hook and locking members when in an open position.

4. The device as set forth in claim 3 wherein said locking members have ridge means for engaging said hook members in a nesting-type relationship.

5. The device as set forth in claim 3 wherein said locking members have locking means thereon for securely affixing said locking members in said first channel means at a desired position.

6. The device as set forth in claim 3 further comprising bias means for biasing together said track member and said cover member.

7. The device as set forth in claim 3 further comprising bias means for selectively biasing said cover member in said open and closed positions.

8. The device as set forth in claim 3 further comprising means for nesting said pair of second hook members with said pair of locking members.

9. The device as set forth in claim 8 wherein said means for nesting comprises a pair of ridges.

* * * * *